US010872529B2

(12) United States Patent
Nordbruch

(10) Patent No.: US 10,872,529 B2
(45) Date of Patent: Dec. 22, 2020

(54) SENSOR DEVICE AND METHOD FOR MONITORING AN OCCUPANCY STATE OF A PARKING SPACE OF A PARKING FACILITY, AND PARKING FACILITY

(71) Applicant: Robert Bosch GmbH, Stuttgart (DE)

(72) Inventor: Stefan Nordbruch, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 172 days.

(21) Appl. No.: 16/095,075

(22) PCT Filed: Mar. 6, 2017

(86) PCT No.: PCT/EP2017/055160

§ 371 (c)(1),
(2) Date: Oct. 19, 2018

(87) PCT Pub. No.: WO2017/182189

PCT Pub. Date: Oct. 26, 2017

(65) Prior Publication Data

US 2020/0349840 A1 Nov. 5, 2020

(30) Foreign Application Priority Data

Apr. 22, 2016 (DE) ..... 10 2016 206 871

(51) Int. Cl.
*G08G 1/14* (2006.01)

(52) U.S. Cl.
CPC ..... *G08G 1/146* (2013.01)

(58) Field of Classification Search
None
See application file for complete search history.

(56) References Cited

U.S. PATENT DOCUMENTS

2002/0186131 A1 12/2002 Fettis
2005/0231869 A1* 10/2005 Yoshikawa ..... H02J 9/06 361/62

(Continued)

FOREIGN PATENT DOCUMENTS

CN 103827936 A 5/2014
CN 103956073 A 7/2014

(Continued)

OTHER PUBLICATIONS

International Search Report dated Jun. 28, 2017 of the corresponding International Application PCT/EP2017/055160 filed Mar. 6, 2017.

*Primary Examiner* — John F Mortell
(74) *Attorney, Agent, or Firm* — Norton Rose Fulbright US LLP; Gerard Messina

(57) ABSTRACT

A sensor device for monitoring an occupancy state of a parking space of a parking facility for motor vehicles includes: at least one parking space sensor connected, via a first electric circuit, to a first electrical energy store for an electrical energy supply of the at least one parking space sensor, a detection device for detecting an interruption of the first electric circuit, a communication interface connected in a second electric circuit for transmitting a signal via a communication network when an interruption of the first electric circuit is detected, the signal indicating the interruption, a second electrical energy store being connected in the second electric circuit for an electrical energy supply of the communication interface.

14 Claims, 1 Drawing Sheet

(56) References Cited

U.S. PATENT DOCUMENTS

| | | | | |
|---|---|---|---|---|
| 2006/0113954 | A1* | 6/2006 | Ma | H02P 27/00 318/803 |
| 2009/0192950 | A1* | 7/2009 | King | G07B 15/02 705/418 |
| 2014/0340240 | A1 | 11/2014 | Becker et al. | |
| 2014/0375206 | A1* | 12/2014 | Holland | H04L 67/125 315/86 |

FOREIGN PATENT DOCUMENTS

| | | | |
|---|---|---|---|
| CN | 104361765 | | 2/2015 |
| CN | 104732170 | | 6/2015 |
| DE | 102014201130 | A1 | 7/2015 |
| WO | 2006/115545 | A1 | 11/2006 |
| WO | 2011/003674 | A1 | 1/2011 |
| WO | 2016/041170 | A1 | 3/2016 |

* cited by examiner

SENSOR DEVICE AND METHOD FOR MONITORING AN OCCUPANCY STATE OF A PARKING SPACE OF A PARKING FACILITY, AND PARKING FACILITY

CROSS-REFERENCE TO RELATED APPLICATIONS

The present application is the national stage of International Pat. App. No. PCT/EP2017/055160 filed Mar. 6, 2017, and claims priority under 35 U.S.C. § 119 to DE 10 2016 206 871.7, filed in the Federal Republic of Germany on Apr. 22, 2016, the content of each of which are incorporated herein by reference in their entireties.

FIELD OF THE INVENTION

The present invention relates to a sensor device for monitoring an occupancy state of a parking facility for motor vehicles. The present invention also relates to a method for monitoring an occupancy state of a parking space of a parking facility for motor vehicles. The present invention furthermore relates to a parking facility for motor vehicles.

BACKGROUND

Published patent application WO 2011/003674 A1 shows a parking space management system for a parking facility, which has at least one parking space, the management system having a central station and a sensor system having at least one parking space sensor associated with the parking space for monitoring an occupancy state of the parking space, the parking space sensor being on or in the floor of the associated parking space. The parking space sensor can be designed to be energy self-sufficient.

Published patent application DE 2014 201 130 A1 shows a method and a device for determining an unauthorized intrusion at a door.

Parking space sensors are normally expensive. There exists therefore a need to protect these against theft or to make theft more difficult.

SUMMARY

An objective of the present invention is to provide a concept that makes it possible to efficiently impede or even prevent a theft of a parking space sensor or to detect it efficiently.

According to one aspect, a sensor device for monitoring an occupancy state of a parking space of a parking facility for motor vehicles includes: at least one parking space sensor for monitoring an occupancy state of a parking space of a parking facility; a first electrical energy store for an electrical energy supply of the at least one parking space sensor; a first electric circuit in which the at least one parking space sensor and the first electrical energy store are connected; a detection device for detecting an interruption of the first electric circuit; a communication interface connected in a second electric circuit for transmitting a signal over a communication network in the event of a detected interruption of the first electric circuit, the signal including the information that the first electric circuit is interrupted; and a second electrical energy store for an electrical energy supply of the communication interface and being connected in the second electric circuit.

According to another aspect, a method for monitoring an occupancy state of a parking space of a parking facility for motor vehicles by using the sensor device according to the present invention includes: monitoring the occupancy state of the parking space using the at least one parking space sensor; and, in the event that the detection device detects an interruption of the first electric circuit, transmitting a signal via the communication interface over the communication network, the signal including the information that the first electric circuit is interrupted.

According to yet another aspect, a parking facility for motor vehicles includes at least one parking space and at least one sensor device of the present invention that is associated with the parking space.

The present invention is based on the recognition that the above objective can be achieved in that a signal is transmitted over a communication network when an interruption of the first electric circuit is detected, the signal including the information that the first electric circuit is interrupted. This advantageously makes it possible to communicate efficiently over the communication network that an improper intervention occurred at the sensor device. For an interruption of the first electric circuit usually indicates, for example, that the parking space sensor was removed from the first electric circuit.

The fact that this information is transmitted over the communication network makes it possible, for example, that an operator of the parking facility is able to take efficient countermeasures. For example, the operator can alarm the police or a security provider who will look into the matter directly on site. A thief can still be caught in time as a result, which in the end would prevent the theft of the sensor device. At least, however, a theft of the sensor device is rendered more difficult.

In particular, this achieves a technical advantage of being able efficiently to detect a theft or an unauthorized intervention.

This yields, in particular, a technical advantage that the information that an unauthorized intervention was made at the sensor device is also made available at a distance from the sensor device so that appropriate countermeasures can then be taken.

Embodiments of the present invention furthermore have the advantage of not requiring elaborate and complex and expensive monitoring systems, for example video cameras, for the sensor device is equipped with its own theft detection device, here the detection device, the detection of an interruption of the first electric circuit representing a simple possibility of detecting an unauthorized intervention, compared for example to a video camera whose video data usually must first be laboriously evaluated by image analysis or must be checked manually by a human being. It is easy to measure and thus determine whether an electric circuit is closed or interrupted.

The formulation "at least one parking space sensor" includes in particular the formulation of "multiple parking space sensors" and also the formulation of a single parking space sensor." That is to say, multiple parking space sensors are provided in an example embodiment. These multiple parking space sensors are designed to be identical for example or are designed to be different for example. Explanations given in connection with one parking space sensor apply analogously to example embodiments including multiple parking space sensors and vice versa.

In an example embodiment, the at least one parking space sensor is designed as one of the following sensors or as a combination of the following sensors: ultrasonic sensor, radar sensor, infrared sensor, magnet sensor, pressure sensor, laser sensor, lidar sensor.

Multiple parking space sensors are provided, for example, which are designed as one of the aforementioned sensors. A radar sensor and a magnet sensor are provided, for example. A combined radar/magnet sensor is provided, for example. That is to say generally that the at least one parking space sensor can be designed as a sensor combination, which includes one or several of the aforementioned sensors. The at least one parking space sensor has for example a functionality of one or of several of the aforementioned sensors.

An occupancy state indicates in particular whether the parking space is occupied or unoccupied. A motor vehicle in particular is thus parked in an occupied parking space. In particular, no motor vehicle is parked in an unoccupied parking space. An unoccupied parking space is thus free of a motor vehicle.

In an example embodiment, a housing includes a housing cover and houses the at least one parking space sensor. This yields in particular a technical advantage of protecting the at least one parking space sensor efficiently against external influences. Such external influences include for example moisture and/or mechanical stress.

Another example embodiment provides for the first electric circuit to include a mechanical switch that is activated by the housing cover so that the switch is closed when the housing cover is closed and is open when the housing cover is open. This yields in particular a technical advantage that an act of opening the housing cover can be detected efficiently and opening the housing cover is necessary for stealing the parking space sensor so as to remove it from the housing. That is to say, a thief who wants to steal the parking space sensor must normally open the housing cover. According to this example embodiment, this is efficiently detected directly. Opening the housing cover thus effects an interruption of the first electric circuit so that the signal is then transmitted accordingly over the communication network.

According to an example embodiment, the mechanical switch is designed as an electromagnetic switch.

Another example embodiment provides for the housing cover to include an electrically conductive housing cover section, the housing including an electrically conductive housing section, an electrically conductive first connection being established between the electrically conductive housing cover section and the electrically conductive housing section when the housing cover is closed, which is interrupted when the housing cover is opened, the first electric circuit including the electrically conductive first connection. This yields in particular a technical advantage of making it possible to recognize or detect the opening of the housing cover efficiently, analogous to the example embodiment described above. The explanations provided above apply here in analogous fashion.

An example embodiment provides for a floor contact to be disposed on an outer side of a floor of the housing, which forms an electrically conductive second connection with a floor countercontact disposed outside of the housing so that when the housing is displaced away from the floor countercontact, the electrically conductive second connection is interrupted, the first electric circuit comprising the electrically conductive second connection. This in particular yields a technical advantage of making it possible to recognize or detect efficiently when the housing is removed from the floor. The example embodiment thus provides for the countercontact on the floor to be disposed in a stationary manner, the housing being positioned with its bottom side on top of the floor countercontact. If a thief now picks up the housing, the first electric circuit is thereby interrupted, which then in turn results in a transmission of the signal.

An example embodiment provides for the detection device to include a current measuring device for measuring an electric current flowing through the first electric circuit and/or a voltage measuring device for measuring an electric voltage applied on the at least one parking space sensor. This yields in particular a technical advantage of making it possible to determine efficiently whether the first electric circuit is open or closed. For if current is no longer flowing within the first electric circuit, then this is a sign that the first electric circuit is interrupted. Normally, the first electrical energy store applies an electric voltage to the at least one parking space sensor, this voltage being measurable only if the first electric circuit is closed.

The detection device includes for example a resistance measuring device for measuring an electrical resistance of the first electric circuit. If the first electric circuit is open, that is, interrupted, a corresponding resistance measurement would normally result in a value that is infinite.

An example embodiment provides for the communication interface to be integrated in the at least one parking space sensor. This yields in particular a technical advantage of making it possible to install the communication interface along with an installation of the parking space sensor. This effects an efficient installation, for example.

An example embodiment provides for the at least one parking space sensor to be additionally connected in the second electric circuit. This yields in particular a technical advantage that the at least one parking space sensor is supplied with electrical energy even when the first electric circuit is interrupted. This is expedient and advantageous, for example, if the communication interface is integrated in the parking space sensor.

An example embodiment provides for the second electrical energy store to be integrated in the at least one parking space sensor. This yields in particular a technical advantage of making it possible to install the second electrical energy store at the same time as an installation of the parking space sensor. This effects an efficient installation.

Technical functionalities of the method derive analogously from corresponding technical functionalities of the sensor device and vice versa.

That is to say in particular that corresponding method features derive from corresponding device features and vice versa.

An example embodiment provides for the at least one sensor device to be disposed on a floor or in the floor of the at least one parking space.

A depression is formed in the floor of the parking space, for example, the sensor device being situated in the depression, in particular in the floor of the depression.

An electrical energy store in the sense of the present invention, that is, in particular the first and/or second electrical energy store, includes for example one or multiple batteries and/or one or multiple accumulators and/or one or multiple capacitors.

According to an example embodiment, the at least one parking space sensor is designed to be energy self-sufficient. That is to say, in particular, that it is not necessary to run electric cables to the sensor device.

According to an example embodiment, the communication network includes a wireless communication network.

A wireless communication network includes for example a mobile telephony communication network and/or a WLAN communication network.

According to an example embodiment, the signal is a telegram, in particular an Ethernet telegram.

According to an example embodiment, the communication network comprises a bus system.

In an example embodiment, the signal is transmitted to a parking facility management system of the parking facility.

In an example embodiment, the signal is received by a parking facility management system via the communication network.

An example embodiment provides for the parking facility management system to initiate one or several actions in response to receiving the signal via the parking facility management system. Actions include for example: alarming the police and/or a security service provider, closing the parking facility, that is, in particular closing the access doors and/or the access gates, and/or outputting an alarm signal.

The present invention will be explained in greater detail in the following with reference to preferred exemplary embodiments.

DETAILED DESCRIPTION

Figure 1:
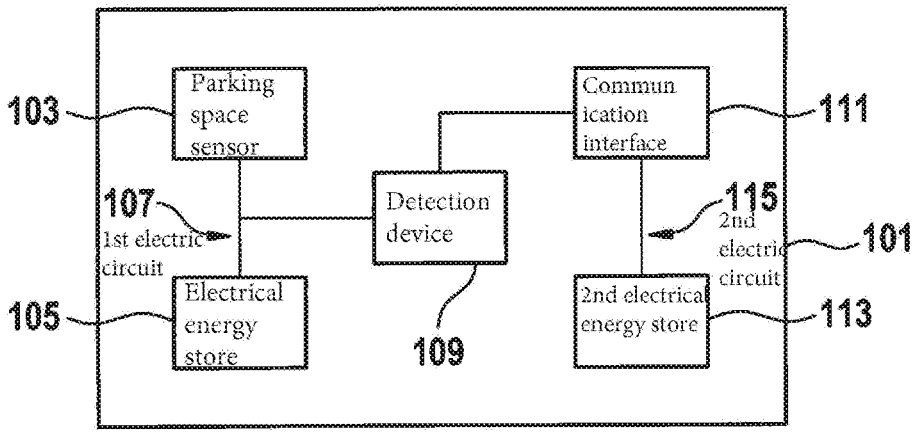
FIG. 1 illustrates a sensor device according to an example embodiment of the present invention.

FIG. 1 shows a sensor device 101 for monitoring an occupancy state of a parking space of a parking facility for motor vehicles. Sensor device 101 includes a parking space sensor 103 for monitoring an occupancy state of a parking space of a parking facility. An example embodiment that is not shown provides for multiple parking space sensors 103.

Sensor device 101 includes a first electrical energy store 105 for an electrical energy supply of parking space sensor 103. That is to say, the first electrical energy store 105 supplies parking space sensor 103 with electrical energy. That is to say, in particular, an electrically conductive connection is formed between parking space sensor 103 and the first electrical energy store 105.

That is to say, a first electric circuit 107 is formed in which parking space sensor 103 and first electrical energy store 105 are connected. Sensor device 101 further includes a detection device 109 for detecting an interruption of first electric circuit 107. That is to say, in particular, detection device 109 is designed so as to detect an interruption of first electric circuit 107.

Sensor device 101 further includes a communication interface 111 as well as a second electrical energy store 113. Second electrical energy store 113 supplies communication interface 111 with electrical energy. That is to say, in particular, communication interface 111 and second electrical energy store 113 are connected in an electrically conductive manner. That is to say, in particular, a second electric circuit 115 is formed in which communication interface 111 and second electrical energy store 113 are connected.

If an interruption of first electric circuit 107 is detected by detection device 109, communication interface 111 transmits a signal via a communication network, which includes the information that first electric circuit 107 is interrupted.

A housing is provided, for example, which includes a housing cover, parking space sensor 103 situated in the housing. This example embodiment provides, for example, that opening the housing cover results in an interruption of first electric circuit 107. The opening of the housing cover is thus detected in an efficient manner, this information then being transmitted as a signal via the communication network.

It is provided, for example, that a floor contact is disposed on an outside of a floor of the housing. A floor countercontact is disposed on the floor of the parking space or in a depression in a floor of a parking space. In the operation of the parking facility, the sensor device is situated with the outside of the housing floor on the floor countercontact. That is to say, in the situated or mounted state, the floor contact forms an electrically conductive second connection with the floor countercontact.

If a person removes the housing from the floor or from the depression in the floor of the parking space, then this second connection will be cut. It is provided that the first electric circuit 107 includes the electrically conductive second connection. That is to say, first electric circuit 107 is interrupted in the event that the second connection is cut, which is detected by detection device 109, so that accordingly a signal is then transmitted via communication interface 111.

Figure 2:
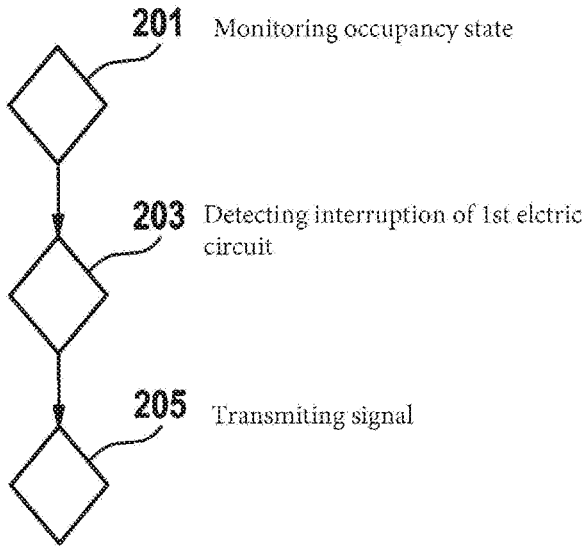
FIG. 2 is a flowchart that illustrates a method for monitoring an occupancy state of a parking space of a parking facility for motor vehicles, according to an example embodiment of the present invention.

FIG. 2 is a flowchart of a method for monitoring an occupancy state of a parking space of a parking facility for motor vehicles by using a sensor device as described above or below. The method includes: monitoring 201 the occupancy state of the parking space using the at least one parking space sensor; and, in the event that detection device detects 203 an interruption of the first electric circuit, transmitting 205 a signal via the communication interface over the communication network, the signal including the information that the first electric circuit is interrupted.

Figure 3:
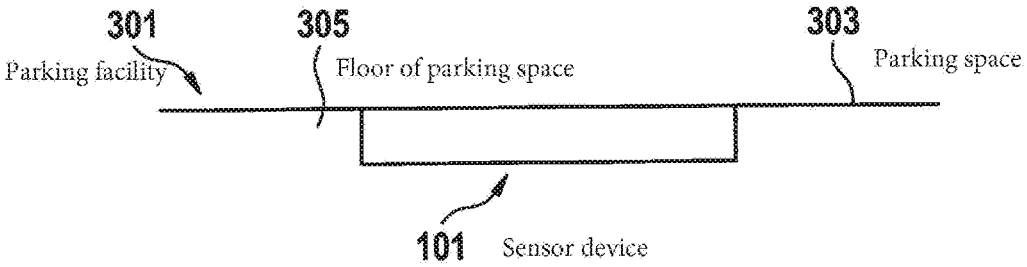
FIG. 3 illustrates a parking facility for motor vehicles according to an example embodiment of the present invention.

FIG. 3 shows a parking facility 301 for motor vehicles. Parking facility 301 includes at least one parking space 303. Sensor device 101, as shown in FIG. 1, is situated in the floor 305 of parking space 303. For the sake of clarity, only a square with reference numeral 101 is shown as a placeholder for the individual elements shown in FIG. 1. Parking facility 301 includes additional parking spaces, which are likewise equipped with corresponding sensor devices in analogy to the setup shown in FIG. 3. If the sensor device is disposed in or on the floor of the parking space, the sensor device can in particular also be called a floor sensor device.

The present invention is thus in particular based on the thought of using the opening or interruption of an electric circuit, in which a parking space sensor and an electrical energy store supplying the parking space sensor are connected, as a criterion for determining that an unauthorized intervention is occurring. That is to say, in particular, if the electric circuit is opened, the parking space sensor still transmits a signal for example by using a stored residual energy. The stored residual energy is stored for example in a battery or in a capacitor, that is, for example, in the second energy store.

This mechanism (that is, the transmission of the signal as a result of an interruption of the electric circuit) is triggered for example when a housing cover and/or a housing is opened.

The mechanism is triggered for example when the housing floor is lifted by triggering a floor (counter)contact.

It is an advantage that a signal, which includes the information that the first electric circuit is interrupted, indicating that an unauthorized intervention in the parking space sensor has been made, is transmitted via the communication network in real time.

In response to receiving the signal, it is then possible for a parking facility management system for example to trigger or perform actions. Such actions include for example alarming police.

What is claimed is:

1. A sensor device, comprising:

a parking space sensor, wherein an occupancy state of a parking space of a parking facility for motor vehicles is monitorable by the parking space sensor;

a first electrical energy store;

a first electric circuit via which the parking space sensor and the first electrical energy store are connected and via which the parking space sensor is suppliable with electrical energy from the first electrical energy store;

a detection device; and a second electric circuit via which a communication interface is suppliable with electrical energy from a second electrical energy store;

wherein the sensor device is configured for responding to a detection by the detection device of an interruption of the first electric circuit by transmitting via the communication interface and over a communication network a signal indicating the interruption.

2. The sensor device of claim 1, further comprising a housing that includes a housing cover, wherein the parking space sensor is situated in the housing.

3. The sensor device of claim 2, wherein the first electric circuit includes a mechanical switch that is activatable by the housing cover so that the switch is closed when the housing cover is closed and is open when the housing cover is open.

4. The sensor device of claim 2, wherein:

the housing cover includes an electrically conductive housing cover section;

the housing includes an electrically conductive housing section;

the first electric circuit includes an electrically conductive connection that (a) is established between the electrically conductive housing cover section and the electrically conductive housing section when the housing cover is closed, and (b) is interrupted when the housing cover is opened.

5. The sensor device of claim 2, wherein the first electric circuit includes an electrically conductive connection formed by a floor contact, disposed on an outside of a housing floor of the housing, with a floor countercontact disposed outside of the housing so that when the housing is displaced away from the floor countercontact, the electrically conductive connection is interrupted.

6. The sensor device of claim 1, wherein:

the detection device includes a current measuring device; and an electric current flowing through the first electric circuit is measurable by the current measuring device.

7. The sensor device of claim 1, wherein:

the detection device includes a voltage measuring device; and an electric voltage applied at the at least one parking space sensor is measurable by the voltage measuring device.

8. The sensor device of claim 1, wherein the communication interface is integrated into the at least one parking space sensor.

9. The sensor device of claim 1, wherein the at least one parking space sensor is additionally connected in the second electric circuit.

10. The sensor device of claim 1, wherein the second electrical energy store is integrated into the at least one parking space sensor.

11. A method for monitoring an occupancy state of a parking space of a parking facility for motor vehicles by using the sensor device, the method comprising:

monitoring, by a parking space sensor that is supplied with electrical energy from a first electrical energy store, an occupancy state of a parking space of a parking space of a parking facility for motor vehicles;

a detection device detecting an interruption in a first electric circuit that connects the parking space sensor to the first electrical energy store; and responsive to the detection, transmitting via a communication interface and over a communication network a signal indicating the interruption, wherein the communication interface is supplied with electrical energy from a second energy store.

12. The method of claim 11, wherein the signal is transmitted to a parking facility management system that responsively initiates an action.

13. A parking facility for motor vehicles, the parking facility comprising:

at least one parking space; and for each of one or more of the at least one parking space, a respective sensor device that includes:

a parking space sensor by which an occupancy state of the respective parking space is detectable;

a first electrical energy store;

a first electric circuit via which the parking space sensor and the first electrical energy store are connected and via which the parking space sensor is suppliable with electrical energy from the first electrical energy store;

a detection device; and a second electric circuit via which a communication interface is suppliable with electrical energy from a second electrical energy store;

wherein the sensor device is configured for responding to a detection by the detection device of an interruption of the first electric circuit by transmitting via the communication interface and over a communication network a signal indicating the interruption.

14. The parking facility of claim 13, wherein the sensor device is disposed on a or in a floor of its respective associated parking space.

* * * * *